US008720559B2

(12) United States Patent
Johnson et al.

(10) Patent No.: US 8,720,559 B2
(45) Date of Patent: May 13, 2014

(54) CEMENTING METHOD AND APPARATUS FOR USE WITH RUNNING STRING HAVING AN OBSTRUCTION

(75) Inventors: Mark O. Johnson, Anchorage, AK (US); Robert Harris, Willow, AK (US); Carl Diller, Las Vegas, NV (US); John Milne, Eustis, FL (US)

(73) Assignees: Baker Hughes Incorporated, Houston, TX (US); BP Corporation North America Inc., Warrenville, IL (US)

( * ) Notice: Subject to any disclaimer, the term of this patent is extended or adjusted under 35 U.S.C. 154(b) by 718 days.

(21) Appl. No.: 12/958,017

(22) Filed: Dec. 1, 2010

(65) Prior Publication Data

US 2012/0138297 A1 Jun. 7, 2012

(51) Int. Cl.
*E21B 33/00* (2006.01)

(52) U.S. Cl.
USPC ..... 166/285; 166/290; 166/291

(58) Field of Classification Search
None
See application file for complete search history.

(56) References Cited

U.S. PATENT DOCUMENTS

| | | | | |
|---|---|---|---|---|
| 7,325,606 | B1 | 2/2008 | Vail, III et al. | |
| 7,827,052 | B2 | 11/2010 | Scott et al. | |
| 2002/0144814 | A1* | 10/2002 | Allamon et al. | 166/177.4 |
| 2008/0128128 | A1 | 6/2008 | Vail et al. | |
| 2010/0012320 | A1 | 1/2010 | Vail, III | |
| 2010/0181079 | A1 | 7/2010 | Johnson et al. | |
| 2010/0200222 | A1* | 8/2010 | Robichaux et al. | 166/250.01 |
| 2010/0218951 | A1* | 9/2010 | Harris et al. | 166/290 |

* cited by examiner

*Primary Examiner* — Jennifer H Gay
*Assistant Examiner* — Caroline Butcher
(74) *Attorney, Agent, or Firm* — Steve Rosenblatt

(57) ABSTRACT

A cementing assembly is mounted to a lower end of a running string. The running string has an obstruction in it such as a cable preventing a wiper dart from passing through. A production string liner wiper plug is secured to the running tool with a shear pin or other device. A dart is temporarily suspended above the liner wiper plug in a manner that cement can be pumped around the dart and through an open bore in the wiper plug. Picking up to let dogs extend followed by setting down releases the dart. Picking up again exposes a lateral port to circulate out contaminated cement. Setting down closes the port and pressure launches the plug to push the cement into the annulus surrounding the string being run in. A passage without restrictions results at the top of the cemented string after the running tool is pulled out of the hole.

18 Claims, 3 Drawing Sheets

CEMENTING METHOD AND APPARATUS FOR USE WITH RUNNING STRING HAVING AN OBSTRUCTION

FIELD OF THE INVENTION

The field of the invention is a method and apparatus for cementing through a running string with an internal obstruction, such as a cable, and more particularly comprising support of a liner wiper plug on the running tool rather than the liner string being cemented so as to avoid restriction of the cemented string from an internal boss to which the liner wiper plug is initially secured with a shear device.

BACKGROUND OF THE INVENTION

When the running string for a tubular production string to be cemented has a conduit or cable running through it making it impossible to push wiper darts through the running string a mechanism to exhaust contaminated trailing interface fluids to the annulus and launch the liner wiper plug needs to be below the running string. One such design was described in detail in US Publication 2010/0181079 and the relevant teachings therein are incorporated by reference herein as if fully set forth. Basically the liner wiper plug 38 shown in FIG. 1 was supported from a support housing with shear pins 64 extending into a housing or boss 63 above the liner wiper plug 38. The housing or boss 63 for the shear pins 64 was secured internally in the production string 36. Initially the stinger or extension 62 was in a bore through the plug 38 so cement could be pumped past the plug to the lower end of the production string 36 and out the bottom and up a surrounding open hole annulus. Fluid was spotted behind the cement to push the cement down toward the plug 38. Since the fluid and the cement were not isolated from each other, some of the cement at the tail end became contaminated and it was desirable to stop pumping before any contaminated cement reached the lower end of the running string 34. At that point the running string was picked up to pull out the extension 62 from the plug 38 which would allow one or more flappers such as 66 to slam shut and further fluid pumping would then circulate out the contaminated cement which was then possible because the seal 68 was no longer in the deployment sleeve 56. After the circulation of the contaminated cement, the running string 34 and tool 32 were run back in to reengage seal 68 and the pressure is built up on the closed flapper valve 66 to break the shear pins 64 and launch the plug 38 into the production string 36 until the plug 38 bumps at the lower end as shown in FIG. 2. The fluid 50 is pumped behind the plug 38 to bump it. Meantime the good cement ahead of the plug is advanced further up the annulus 48 while displacing wellbore fluids ahead of the cement toward the surface at 42. All cement above the production string is circulated out of the well. After cement hardens around the production string it can then be perforated and produced.

There were several issues with the above described process. One was the cost of the wiper plug assembly 38 that generally included a plurality of flappers 66. This was a very expensive device to build. More significantly the boss 63 that supported the shear pin that in turn held the liner wiper plug assembly in position remained behind inside the production string 36 and presented a reentry restriction and a flow choke point to later production. Alternatively going in and milling it out in a separate trip was time consuming and expensive.

The present invention solves that problem by providing a support for the liner wiper plug on the running tool rather than in the string being run. The wiper plug has a open passage through it that can be closed with a releasable dart this is also supported in the running tool at a point above the liner wiper plug. The dart is temporarily supported so that flow can bypass around it and go through the open bore in the liner wiper plug. When the cement is pumped and the contaminated cement is to be circulated out, the running tool is picked up to deploy extendable dogs. A set down with the dogs on the top of the production string shifts a sleeve to remove support for the dart allowing it to move downward to plug off the bore in the liner wiper plug. A subsequent pickup force pulls upper seals 130 out of the production string and exposes a lateral port above the landed dart and circulation can get the contaminated cement back to the surface through the annulus. Setting back down again reengages the seals 130 and closes the lateral port and allows a pressure buildup to release the liner wiper plug with the dart in it so that the cement is displaced from the string being cemented and into the surrounding annulus. The liner wiper plug is retained to the running tool with shear pins or collets in the running tool. When the running tool is pulled, there are no longer any restrictive bosses internally in the cemented string to restrict access or throttle subsequent production. Those skilled in the art will more readily appreciate more aspects of the invention from a review of the detailed description of the preferred embodiment and the associated FIGS. 3-7 while understanding that the full scope of the invention is to be found in the appended claims.

SUMMARY OF THE INVENTION

A cementing assembly is mounted to a lower end of a running string. The running string has an obstruction in it such as a cable preventing a running string dart from passing through. The liner wiper plug is secured to the running tool with a shear pin or collet. A dart is temporarily suspended above the liner wiper plug in a manner that cement can be pumped around the dart and through an open bore in the liner wiper plug. Picking up to let dogs extend followed by setting down releases the dart. Picking up again exposes a lateral port to circulate out contaminated cement. Setting down closes the port and pressure launches the dart and liner wiper plug to push the cement into the annulus surrounding the string being run in. A passage without restrictions results at the top of the cemented string after the running tool is pulled out of the hole.

DETAILED DESCRIPTION OF THE PREFERRED EMBODIMENT

Figure 3:
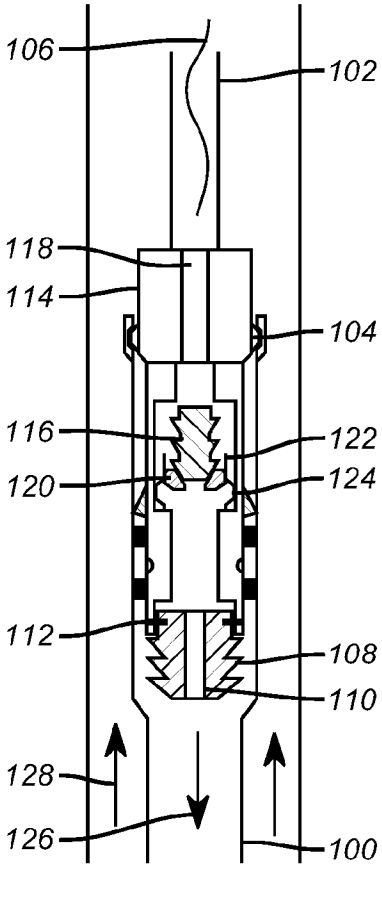
FIG. 3 shows the cementing assembly of the present invention in the run in position.

Referring to FIG. 3, a production string 100 is supported by a running string 102 at releasable latch 104. A cable or line 106 provides an obstruction in running string 102 making it impossible to advance a cement running string wiper dart through it. For that reason the production string wiper plug 108 with its through passage 110 is suspended using one or more shear pins or other release device 112 to the cementing or sealing housing 114 at the lower end of running string 102. Those skilled in the art will appreciate that cement is but one of the materials that can be used to seal the tubular string 100 in a surrounding annulus. A dart 116 is suspended in flowpath 118 of housing 114 by movable supports 120 that are held in position with a sleeve 122 that has a recess 124 that for run in is held offset from supports 120 to prevent the supports 120 from moving. The placement of the dart 116 in flowpath 118 of housing 114 allows fluids represented by arrow 126 to bypass the dart 116 on its exterior and to continue through the passage 110 in the wiper plug 108 and on into the production string 100 to its lower end that is not shown and then back up the annulus outside the string 100 as represented by arrow 128. During the running in a fluid to clean up the well can be circulated as shown in FIG. 3.

Figure 4:
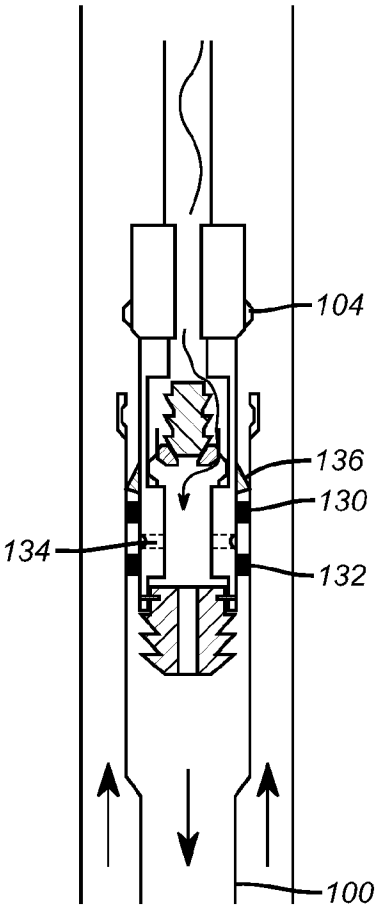
FIG. 4 is the view of FIG. 3 showing the liner released with a release mechanism (ball drop activated, flow activated, or electrically activated) and a subsequent pickup force.

When the desired location is reached in FIG. 4 the first thing that is done is to activate a release mechanism at the latch 104 so that the running tool housing 114 can be released from the production string. This is done prior to cementing because it is important to know at the surface that there is an ability to release before cement is delivered. The running string is only raised an amount that leaves seals 130 and 132 and the port 134 that is between them and communicates to flowpath 118 within the string 100 or within an adapter sleeve mounted to it that supports the latch 104. Spring loaded dogs 136 are also still within the string 100. In this position the cement is delivered in a measured quantity that insures some of the cement is in running string 102 above the housing 114. There is no wiper dart separating the cement and the fluid pumped in behind it because of the obstruction of cable 106. As a result the tail end of the cement is contaminated with the driving fluid and has to get eventually circulated out as opposed to being delivered into the string 100 and winding up in the annular space around it and ruining the cement job.

Figure 5:
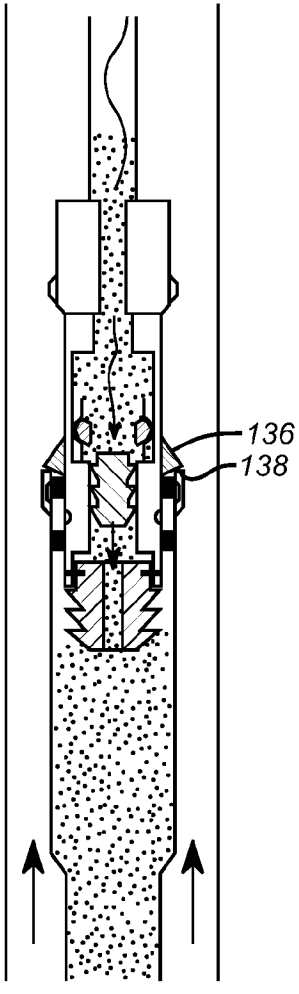
FIG. 5 is the view of FIG. 4 with the dogs popped out after a further pick up force and the dart released due to a set down force on the extended dogs.

FIG. 5 illustrates the result of a further pickup force and a subsequent set down force after cement delivery. During the pickup force the dogs 136 are biased out to the extended position so that on subsequent setting down they will land on the top 138 of the string 100. Further setting down weight with the dogs 136 supported operates the sleeve 122 to place the recess 124 opposite supports 120 which allows supports 120 to retract enough to let the dart 116 fall and obstruct passage 110 in wiper plug 108.

Figure 6:
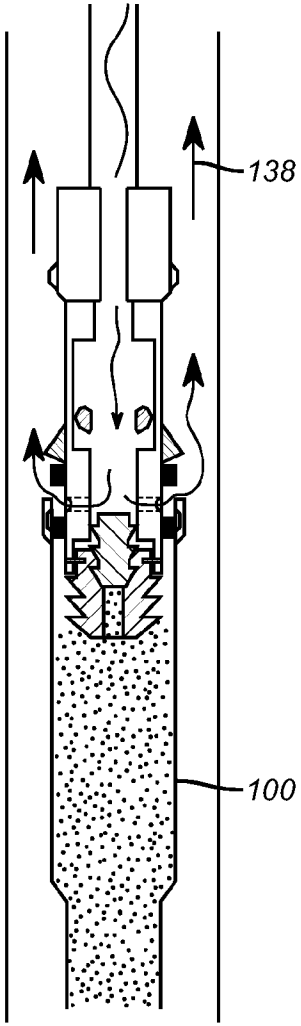
FIG. 6 is the view of FIG. 5 with the passage in the liner wiper plug blocked by engagement of the dart, and a pick up force to expose a lateral port to circulate out contaminated cement.

FIG. 6 shows another pickup force to lift the top seals 130 above the production string and expose the port 134 while the dart 116 obstructs the passage 110 in the plug 108. More fluid is pumped to circulate out the contaminated cement as represented by arrows 138. The interior of string 100 is isolated by plug 108 and dart 116 sealing off passage 110.

Figure 1:
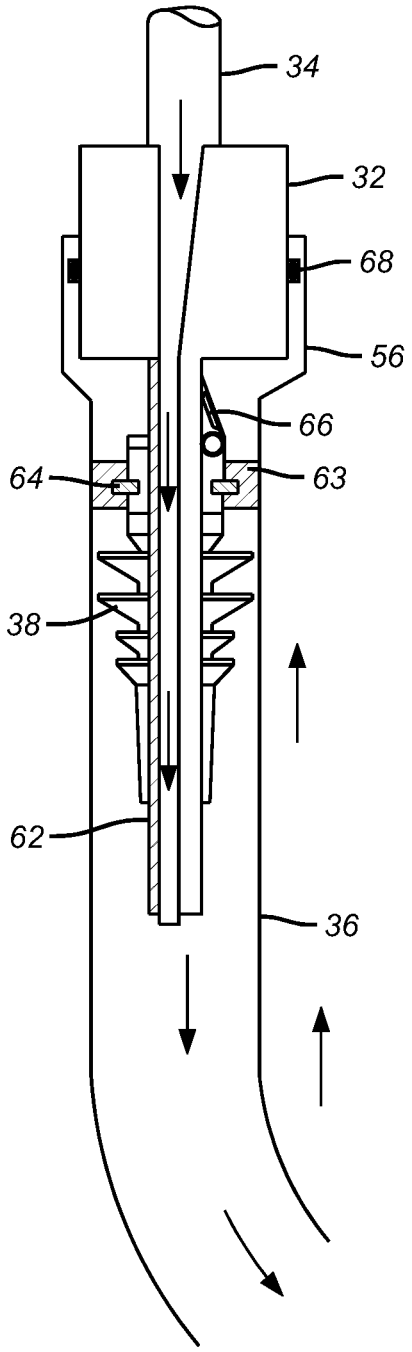
(PRIOR ART) FIG. 1
FIG. 1 is a view of a prior art liner wiper plug arrangement for use with a running string having an obstruction.
Figure 2:
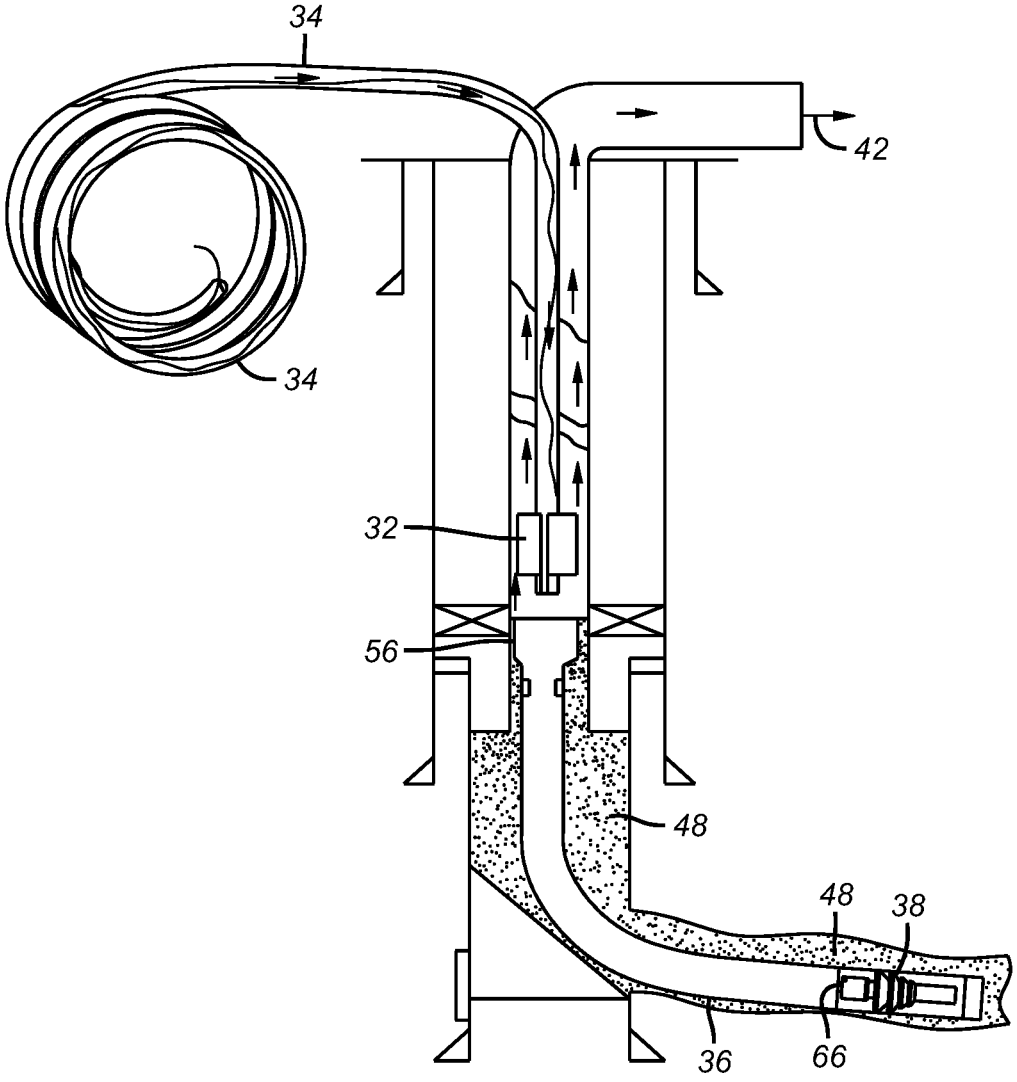
(PRIOR ART) FIG. 2
FIG. 2 is a system view using the liner wiper plug of FIG. 1 to displace cement and the running tool to circulate contaminated cement out to the surface.
Figure 7:
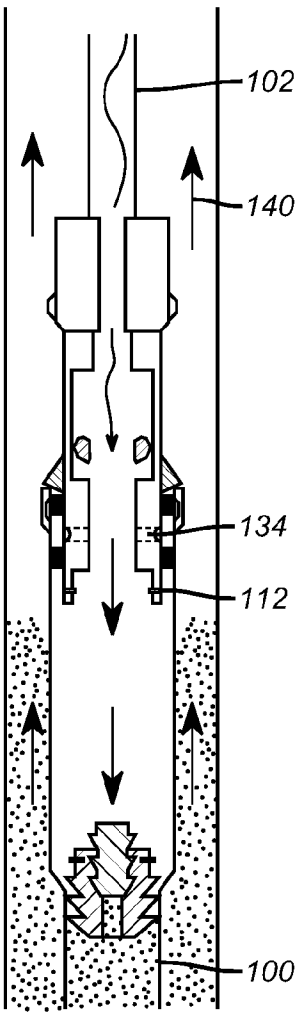
FIG. 7 is the view of FIG. 6 but with a set down force to reengage upper seals and close the lateral ports and internal pressure applied to launch the liner wiper plug and displace cement.

In FIG. 7 the weight is set down again after the circulation in FIG. 6 to reengage seal 130 and close off the ports 134 inside the string 100. Pressure is built up through the running string 102 to break the shear pins 112 or other retaining mechanism and to launch the combination of the liner wiper plug 108 with the dart 116 to displace the cement out the bottom of the string 100 and into the surrounding annulus. The advancing cement in the annulus displaces well fluids ahead of it as represented by arrow 140.

Once the cement sets up the string 100 can be perforated and production can begin with a desired completion assembly in place.

Those skilled in the art will realize that in this type of cementing example the string 100 is the production string but it could also be an intermediate string or drilling liner for extending the wellbore further into the formation. The location of the support for the plug 108 on the housing 114 as opposed to within the string 100 as in the past allows unrestricted access and flow through the string 100 when placed in production because the boss that supported the shear pins in the prior design is now in the housing 114 and comes out of the hole with the housing 114 before production starts.

Another advantage is the multiple flappers of the old design inside the wiper plug passage are not used. The construction of plug 108 is far simpler and cheaper to manufacture. The support of the dart 116 that allows cement to bypass and launches the dart with undermining the supports 120 using the dogs 136 operating a sleeve 122 makes the operating mechanism simpler, more reliable, and reusable for another job. The combination of the dart in the liner wiper plug is also a more reliable seal than a stack of flappers that can present more operation issues of not fully sealing as in part explained by the use of multiple stacked flappers for insurance that the plug can be driven without flow through that would contaminate the cement. The driving fluid is intended exclusively for driving the plug.

The above description is illustrative of the preferred embodiment and many modifications may be made by those skilled in the art without departing from the invention whose scope is to be determined from the literal and equivalent scope of the claims below.

We claim:

1. A method of sealing a tubular string at a subterranean location, comprising:

delivering the tubular string to a desired location with a sealing assembly supported by a running string having an obstruction that prevents passage of a wiper dart;

supporting a liner wiper plug with the sealing assembly with the liner wiper plug located in the tubular string;

flowing a sealing material through a passage in said liner wiper plug and around an obstructing member that is selectively released to obstruct said passage;

releasing said obstructing member to land on said passage;

launching the liner wiper plug to displace sealing material through said tubular string; and removing the sealing assembly with said running string.

2. The method of claim 1, comprising:

undermining support for said obstructing member;

closing said passage with said obstructing member.

3. The method of claim 2, comprising:

picking up said running string after closing said passage;

exposing a lateral port from said flowpath to outside said tubular string;

removing sealing material contaminated by driving fluid behind said sealing material through said lateral port.

4. The method of claim 3, comprising:

providing seals to straddle said lateral port;

closing said lateral port by moving said seals into said tubular string.

5. The method of claim 4, comprising:

pressurizing said sealing assembly with said lateral port closed;

releasing said support for said wiper plug with said pressure for said launching.

6. The method of claim 5, comprising:

leaving no access restriction or flow obstruction in said tubular string in the region where said sealing assembly was disposed upon removal of said sealing assembly.

7. The method of claim 1, comprising:

leaving no access restriction or flow obstruction in said tubular string in the region where said sealing assembly was disposed upon removal of said sealing assembly.

8. A method of sealing a tubular string at a subterranean location, comprising:

delivering the tubular string to a desired location with a sealing assembly supported by a running string having an obstruction that prevents passage of a wiper dart;

supporting a liner wiper plug with the sealing assembly with the liner wiper plug located in the tubular string;

launching the liner wiper plug to displace sealing material through said tubular string; and removing the sealing assembly with said running string;

initially providing an open passage through said liner wiper plug for passage of sealing material;

subsequently closing said passage to launch said wiper plug;

providing a through flowpath in said sealing assembly;

supporting an obstructing member in said flow path without obstructing flow through said flowpath;

bypassing sealing material around said obstructing member and directing the sealing material through said passage in said liner wiper plug;

undermining support for said obstructing member;

closing said passage with said obstructing member;

setting down weight on said running string for said undermining.

9. The method of claim 8, comprising:

shifting a sleeve with said setting down weight.

10. The method of claim 9, comprising:

picking up said running string before said setting down;

extending at least one dog with said picking up;

operatively engaging said dog to said sleeve.

11. The method of claim 10, comprising:

landing said dog on said tubular string;

moving said sleeve with respect to said support;

allowing said support to move away from said obstructing member.

12. A cementing assembly for subterranean use, comprising:

a housing having a flowpath therethrough, said housing selectively located in a tubular to be cemented, said tubular supported by a running string;

a liner wiper plug having a passage therethrough, said passage aligned with said flowpath when said liner wiper plug is supported by said housing;

an object initially supported in said flowpath so that flow can bypass around said object and exit said flowpath through said passage in said liner wiper plug and said object selectively releasable to obstruct said passage.

13. The assembly of claim 12, wherein:

said object comprises a dart supported by a movable support.

14. The assembly of claim 13, wherein:

said movable support retained in a supporting position for said dart by a movable member actuated from outside said housing.

15. A cementing assembly for subterranean use, comprising:

a housing having a flowpath therethrough;

a liner wiper plug having a passage therethrough, said passage aligned with said flowpath when said liner wiper plug is supported by said housing;

an object initially supported in said flowpath so that flow can bypass said object and exit said flowpath through said passage in said liner wiper plug and said object selectively releasable to obstruct said passage;

said object comprises a dart supported by a movable support;

said movable support retained in a supporting position for said dart by a movable member actuated from outside said housing;

said housing further comprises at least one biased dog that extends when said housing is moved out of a surrounding tubular, said dog operatively engaged to said movable member, whereupon relative movement between said housing and said dog allows said movable support to release said dart to close said passage in said liner wiper plug.

16. The assembly of claim 15, wherein:

said housing comprises a selectively closed lateral port communicating with said flowpath.

17. The assembly of claim 16, wherein:

said housing comprises spaced seals externally straddling said port to maintain said port closed when said seals are within a surrounding tubular;

said dart, when released by said movable support to close said passage in said liner wiper plug moving past said port in said flowpath, whereupon opening said port flow into said housing is directed out of said port and is stopped by said dart blocking said passage in said liner wiper plug.

18. The assembly of claim 17, wherein:

landing said dog on a surrounding tubular reengages said seal and closes said port so that pressure in said flowpath launches the dart and liner wiper plug in tandem.

* * * * *